United States Patent [19]

Smith

[11] 3,944,130

[45] Mar. 16, 1976

[54] CONTAINER AND BLANK

[75] Inventor: Ernest L. Smith, Kansas City, Mo.

[73] Assignee: Phillips Petroleum Company, Bartlesville, Okla.

[22] Filed: Sept. 3, 1974

[21] Appl. No.: 502,855

[52] U.S. Cl. ..... 229/37 R; 229/17 R; 229/43

[51] Int. Cl.[2] ..... B65D 5/02

[58] Field of Search ..... 229/37 R, 17 G, 17 R, 7 R, 229/43

[56] References Cited

UNITED STATES PATENTS

| | | | |
|---|---|---|---|
| 2,251,283 | 8/1941 | Johnson | 229/37 R |
| 2,321,313 | 6/1943 | Pelzer | 229/37 R X |
| 2,471,017 | 5/1949 | Wilcox | 229/5.5 |
| 2,643,815 | 6/1953 | Komeo | 229/37 R X |
| 2,702,152 | 2/1955 | Britton | 229/17 G |
| 2,704,179 | 3/1955 | Wilcox | 229/5.5 |
| 2,730,288 | 1/1956 | Dixon | 229/17 G |
| 3,195,795 | 7/1965 | Wilcox | 229/7 R |

*Primary Examiner*—William Price
*Assistant Examiner*—Stephen P. Garbe

[57] ABSTRACT

A container formed of paperboard or the like is provided with a lower rectangular section and an upper tapered section which forms a truncated pyramid. The bottom can also be tapered. A blank is disclosed which can be employed to form the side walls of the container.

6 Claims, 3 Drawing Figures

CONTAINER AND BLANK

It is common practice to package liquids and granular solids in containers formed of paperboard, cardboard and the like. Such containers are generally of rectangular or cylindrical construction. Containers of rectangular configuration are commonly employed to package milk, particularly in one-half gallon and smaller-sized containers. While these containers are quite successful, it is sometimes desirable to employ a container of a different configuration, particularly when the container is to be used to package a material other than milk.

In accordance with this invention, a container is provided which is of generally rectangular cross section at any given vertical location, but which is tapered to provide a top of smaller cross section than the lower region. The lower region of the container can thus be of uniform rectangular cross section, whereas the upper region is in the form of a truncated pyramid. Containers of this configuration are formed in accordance with this invention from generally rectangular blanks which are provided with a series of score lines which form the corners of the container. The upper section of the blank is provided with additional score lines which form pleats which permit the tapered construction and serve to strengthen the top of the container. In another embodiment of this invention, the bottom is also of tapered configuration.

In the accompanying drawing.

Figure 1:
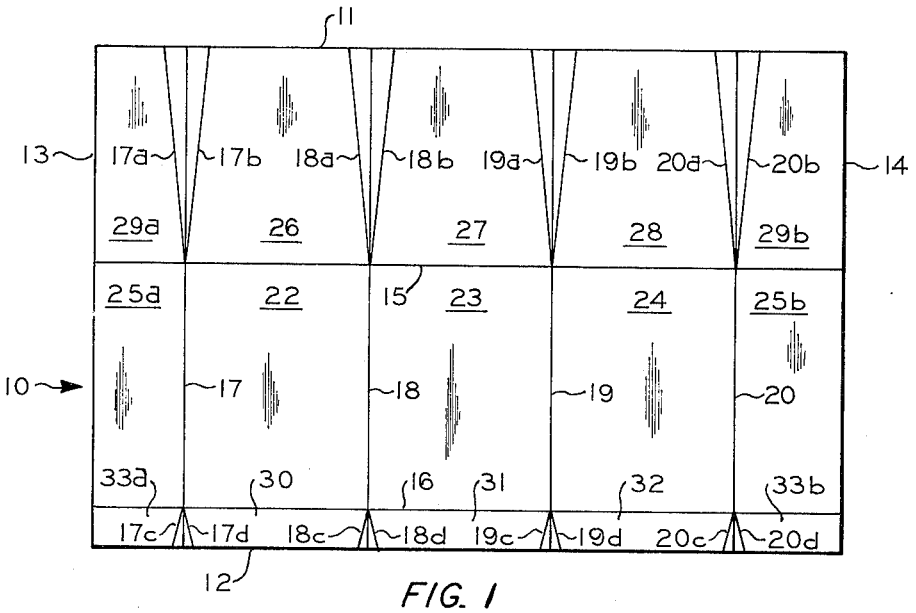
FIG. 1 illustrates a blank formed in accordance with this invention.

Referring now to the drawing in detail and to FIG. 1 in particular, there is shown a generally rectangular blank 10 which is formed of paperboard, cardboard or the like. The blank advantageously is coated with a material such as polyethylene or wax which decreases the permeability of the blank and provides a surface which can be heat sealed when the blank is formed into a carton. Blank 10 is provided with an upper edge 11, a bottom edge 12, and side edges 13 and 14. A first score line 15 extends between edges 13 and 14 and is parallel to edges 11 and 12. A second score line 16 can be formed near the bottom of the blank parallel to lower edge 12. A plurality of score lines 17, 18, 19 and 20 extend between upper and lower edges 12 in spaced relationship with one another and parallel to side edges 13 and 14. Score lines 17 to 20 define edges of the assembled carton.

Angular score lines 17*a* and 17*b* extend upwardly and outwardly from the intersection of score lines 15 and 17 to form acute angles with score line 17 located therebetween. Similar annular score lines 18*a* and 18*b*, 19*a* and 19*b*, and 20*a* and 20*b* are associated with respective score lines 18, 19 and 20. The score lines thus far described divide blank 10 into rectangular lower side panels 22, 23, 24, 25*a* and 25*b*, and upper side wall panels 26, 27, 28, 29*a* and 29*b*.

In the embodiment of this invention illustrated in FIG. 1, additional angular score lines 17*c* and 17*d* are formed which extend downwardly from the intersection of score lines 16 and 17. Corresponding score lines 18*c* and 18*d*, 19*c* and 19*d*, and 20*c* and 20*d* are associated with respective score lines 18, 19 and 20. These additional score lines result in bottom side wall panels 30, 31, 32, 33*a* and 33*b* being formed.

Figure 2:
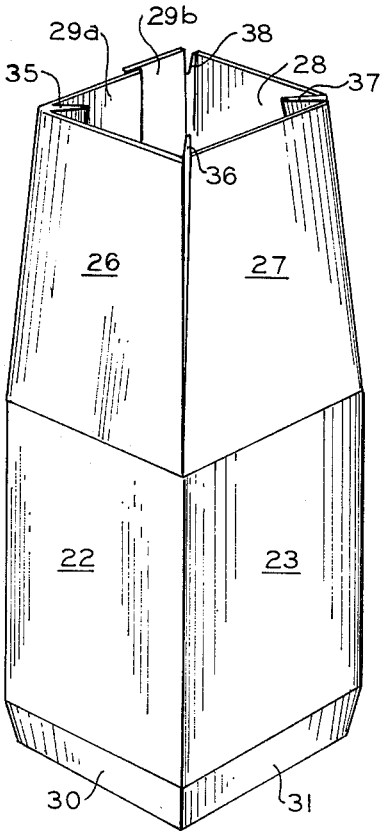
FIG. 2 illustrates a partially assembled container formed from the blank of FIG. 1.

The container of this invention is formed by blending blank 10 along the score lines to form a carton of generally rectangular configuration as illustrated in FIG. 2. Edge 14 overlaps edge 13 and sections of the blank adjacent these edges are sealed together such as by the application of heat which melts the coating on the paperboard to form the seal. As an alternative, an adhesive can be applied to the overlapped edges. The corners of the upper side wall panels are folded inwardly to form pleats 35, 36, 37 and 38, as illustrated in FIG. 2. These pleats may then be bent sidewardly and sealed to an adjacent upper side panel to form an unobstructed top opening. However, this bending is not required in all situations, depending upon the configuration of the top closure employed. In similar fashion, the corners of the bottom section of the blank are folded inwardly.

Figure 3:
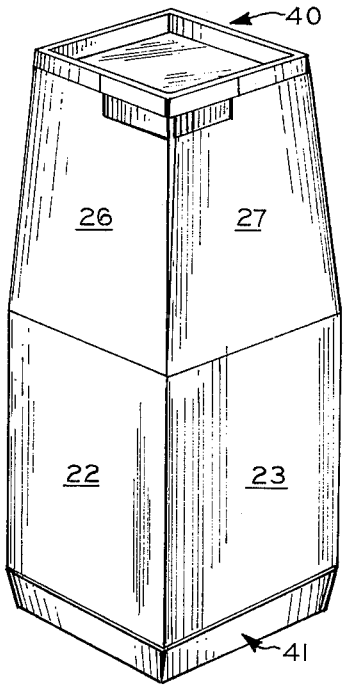
FIG. 3 illustrates an assembled container having top and bottom end closures thereon.

The partially assembled container illustrated in FIG. 2 can then be provided with a suitable bottom closure 41, as shown in FIG. 3. This closure can be of the type described in U.S. Pat. No. 2,704,179, for example. After the container is filled, a suitable top closure 40 can be placed on the carton. Top closures which can be employed are illustrated in U.S. Pat. Nos. 2,471,017 and 3,195,795, for example. As an alternative, a solid top closure can be employed with a suitable opening, such as a pour spout, formed in one of the upper side wall panels or in the top closure itself. The particular top closure employed depends to some extent on the nature of the material to be packaged.

The relative heights of the lower side wall and upper side wall panels can be varied to produce cartons of different configurations. Similarly, the angles at which the angular score lines are formed determine the amount of taper provided in the upper section of the carton. Although the illustrated carton has a square cross section with the distances between adjacent score lines 17 to 20 being equal, this is not essential. The carton of this invention can be provided with or without the illustrated tapered bottom section. As previously mentioned, pleats 35 to 38 serve to strengthen the upper region of the container. The pleats in the bottom section strengthen the bottom. This is particularly desirable when the container is employed to package a material which is used in relatively small quantities at a given time and must be opened a number of times during the life of the container. The tapered upper section provides a container which is more convenient to use, particularly when liquids are to be dispensed.

While this invention has been described in conjunction with presently preferred embodiments, it should be evident that it is not limited thereto.

What is claimed is:

1. A container blank comprising:

a sheet of paperboard or the like of rectangular configuration having upper and lower edges and first and second side edges;

a first score line extending from the first side edge to the second side edge in spaced relationship with and parallel to the upper and lower edges;

four second score lines, each extending from the upper edge to the lower edge and being parallel to the side edges, the second score lines being spaced from one another to form the edges of a container of rectangular cross section when the blank is formed into a container by bending at the second score lines;

four pairs of third score lines, each pair extending from a respective intersection of the first score line and one of the second score lines to the upper edge, the pair forming an acute angle with one another with the respective second score line being located therebetween;

a fourth score line extending from the first side edge to the second side edge, said fourth score line being parallel to the first score line and being positioned between the first score line and the lower edge; and four pairs of fifth score lines, each pair extending from a respective intersection of the fourth score line and one of the second score lines to the lower edge, the pair forming an acute angle with one another with the respective second score line being located therebetween.

2. The blank of claim 1 wherein the sheet is coated with a thermoplastic material.

3. The blank of claim 1 wherein the distances between adjacent second score lines are equal.

4. A container formed from the blank of claim 1 wherein the blank is bent along the score lines to form a container of rectangular center section between the first and fourth score lines, an upper truncated pyramid section between the first score line and the upper edge, and a lower truncated pyramid section between the fourth score line and the lower edge; and the blank is sealed at the region of the side edges.

5. The container of claim 4 wherein the sections of the blank between the pairs of third score lines are bent inwardly to form pleats.

6. The container of claim 4 having a closure member extending across the end of the container adjacent the lower edge.

* * * * *